US005205576A

United States Patent [19]

Bogner et al.

[11] Patent Number: 5,205,576

[45] Date of Patent: Apr. 27, 1993

[54] SIDEWAYS RELEASABLE TOE JAW OF A SKI BINDING

[75] Inventors: Martin Bogner, Ostfildern; Otto Harsányi, Leonberg, both of Fed. Rep. of Germany

[73] Assignee: GEZE Sport International GmbH, Leonberg, Fed. Rep. of Germany

[21] Appl. No.: 753,296

[22] Filed: Sep. 3, 1991

[30] Foreign Application Priority Data

Sep. 4, 1990 [DE] Fed. Rep. of Germany ..... 4027995

[51] Int. Cl.[5] ..... A63C 9/085

[52] U.S. Cl. ..... 280/629; 280/628; 280/634

[58] Field of Search ..... 280/625, 626, 628, 629, 280/630, 631, 634

[56] References Cited

U.S. PATENT DOCUMENTS 4,337,965 7/1982 Salomon ..... 280/628
4,763,908 8/1988 Dimier ..... 280/629
4,889,359 12/1989 Kowatsch et al. ..... 280/629

FOREIGN PATENT DOCUMENTS 3825682 2/1990 Fed. Rep. of Germany .

*Primary Examiner*—Eric D. Culbreth

*Attorney, Agent, or Firm*—Townsend and Townsend; Khourie and Crew

[57] ABSTRACT

A sideways releasable jaw of a ski binding for holding one end of the ski boot (9) has a binding housing (11) in which a release spring (14) is arranged The release spring (14) extends substantially in the longitudinal direction of the ski and is braced at one end against the binding housing (11). At its other end it exerts a release force with a substantial component in the longitudinal direction of the ski pointing away from the ski boot (9) on a sole clamp (22) arranged towards the ski boot (9). On exceeding a predetermined sideways force exerted by the ski boot (9) the sole clamp (22) can pivot sideways about a substantially upright pivotal axis and releases the ski boot (9). In so doing the release spring exerts a downwardly directed force component on the sole clamp which is vertically displaceably arranged on the binding housing (11) for movement along an upright sliding guide. Thus the sole clamp (22) is pressed against the upper side of the sole (29) of the ski boot. The sliding guide (25, 26) has at least two sections (25', 26', 25'', 26'') which are differentially inclined relative to the line of action (27) of the release spring force so that an instantaneous center of rotation M is formed which is arranged at a distance a above the line of action (27) of the release spring force.

5 Claims, 3 Drawing Sheets

SIDEWAYS RELEASABLE TOE JAW OF A SKI BINDING

BACKGROUND OF THE INVENTION

The invention relates to a sideways releasable jaw, in particular the toe jaw of a ski binding for holding one end of a ski boot which also has a jaw holding the other end of the ski boot, in particular a heel jaw, which preferably also exerts a resilient thrust force in the longitudinal direction of the ski on the releasable jaw via the ski boot. The sideways releasable jaw comprises a binding housing in which a release spring is arranged which extends substantially in the longitudinal direction of the ski and which is supported at one end on the binding housing. With its other end the release spring exerts a release force having a substantial component in the longitudinal direction of the ski in a direction away from the ski boot on a sole clamp arranged towards the ski boot. The sole clamp has two side limbs and a hold-down member. The release force is exerted on the sole clamp in such a way that the side limbs, on exceeding a predetermined sideways force exerted by the ski boot, pivot sideways about at least one essentially upright tilt axis and release the ski boot. The sole clamp is vertically displaceably arranged on the binding housing along at least one essentially upright sliding guide. This sliding guide is so inclined relative to the line of action of the release spring force that the release spring exerts a downwardly directed force component on the hold-down member which is thereby pressed against the upper side of the sole of the ski boot.

A sideways releasable jaw of this kind, in particular a front jaw unit of a ski binding, is for example known from DE 38 25 682 A1. This known front jaw unit operates largely satisfactorily. However, the essentially upright sliding guide must be so formed or inclined to the line of action of the release spring force that the force component of the release spring force which operates downwardly on the sole clamp or on the hold-down member is sufficient to overcome the friction in the sliding guide and thus press the hold-down member downwardly against the sole of the ski boot.

On the other hand it is however necessary, in order to achieve a good and defined sideways release behavior of the jaw, not to incline the sliding guides too strongly, in particular when the tilting axes for the lateral outward pivoting of the jaw are also provided in the area of the sliding guides.

SUMMARY OF THE INVENTION

The invention is now based on the object of providing a sideways releasable jaw of the initially named kind which, with a simple construction, makes troublefree pressing down of the hold-down member provided on the sole holder possible but without the sideways releasability of the jaw being impaired.

This object is satisfied in accordance with the invention in that the sliding guide has at least two sections which are differentially inclined relative to the line of action of the release spring force such that an instantaneous turning pole M is formed which is arranged at a distance "a" above the line of action of the release spring force.

Thus, in accordance with the invention, the sliding guide has sections which are differentially inclined relative to the line of action of the release spring force so that a moment turning pole is formed the spacing of which from the line of action of the release spring force determines the force component with which the hold-down member is pressed against the upper side of a ski boot sole. In this way an increase in the size of the hold-down force can be achieved without the sliding guide having to be inclined as a whole by a large amount relative to the line of action of the release spring force. In this manner one can also ensure that the sliding guide is only inclined by a relatively small amount relative to the line of action of the release spring force, in particular in the region of the tilting axis for the lateral outward pivoting of the jaw, so that a troublefree lateral release can be ensured.

If, in this arrangement, the sliding guide is, for example, split up into two straight line sections of which the upper one is inclined by a small degree and the lower one is relatively more inclined, then the sole holder is braced, as a consequence of the forwardly directed elastic thrust force with the inserted ski boot essentially against the upper section of the sliding guide. This upper section of the sliding guide then forms a tilting axis for sideways release which is only tilted by a small amount. This is more favorable the sideways release of the jaw.

Furthermore, it is possible in this way to arrange the release spring essentially parallel to the longitudinal axis of the ski so that the adjusting screw for the release spring is more accessible and the adjustment of the release force is thereby facilitated, since the force which urges the sole hold-down member downwardly is generated by the formation of a torque.

In a particularly advantageous further development of the invention provision is made for the sliding guide to be formed as a circular arc the center of curvature D of which forms the instantaneous turning point.

In this way a particularly good sliding guidance of the sole holder is achieved, and at the same time it is possible to realize a tilting axis for sideways release which stands essentially perpendicular to the surface of the ski.

In order to achieve a troublefree operation of the jaw with a simultaneously long life provision is made in accordance with the invention that the sliding guide of the sole holder on the binding housing is formed by a sliding strip and by a corresponding sliding guide surface, with at least one section of the sliding strip comprising a material with an increased resistance to wear, preferably a metal.

In this arrangement it is expedient when the upper section of the sliding strip, which has a smaller inclination relative to the line of action of the release spring force than the lower section, comprises wear resistant material. In this way a particularly long life is obtained for the section of the sliding strip which is additionally loaded as the tilting hinge.

It is however also possible for the entire sliding strip to consist of wear resistant material.

A further embodiment of the invention is characterized in that two sliding guides are arranged symmetrically to the central longitudinal plane of the ski which stands perpendicular to the surface of the ski and each has a sliding strip and an associated sliding guide surface, with the tilting axes for lateral outward pivoting movement of the sole clamp being arranged in the region of the sliding strips.

In a particularly advantageous further development of the invention provision is made for an intermediate piece to be arranged in the region of each sliding guide between the binding housing and the sole clamp; and for the intermediate piece to form a sliding guide with the sole clamp and a tilting joint with the binding housing, with the tilting axis of each intermediate piece being arranged perpendicular to the line of action of the release spring force.

Through the intermediate piece provided in accordance with the invention in the region of each sliding guide the tilting hinge between the sole clamp and the binding housing can be ideally aligned with reference to the line of action of the release spring force. This is possible without having to renounce the layout of the sliding guide surfaces which is advantageous in accordance with the invention. A press-down movement of the sole clamp which has practically no undesired influence on the release force can in particular be achieved when the sliding guide surfaces are of circular arc-like shape, because the adjusted length of the release spring is practically not changed as a consequence of the downward pivoting movement of the sole clamp.

It is particularly advantageous when the intermediate piece consists of a material with a reduced coefficient of sliding friction, at least in the region associated with the sliding guide, or carries a coating which reduces the sliding friction.

BRIEF DESCRIPTION OF THE DRAWINGS

The invention will be described in the following by way of example and with reference to the drawing in which are shown.

DESCRIPTION OF THE PREFERRED EMBODIMENT

Figure 1:
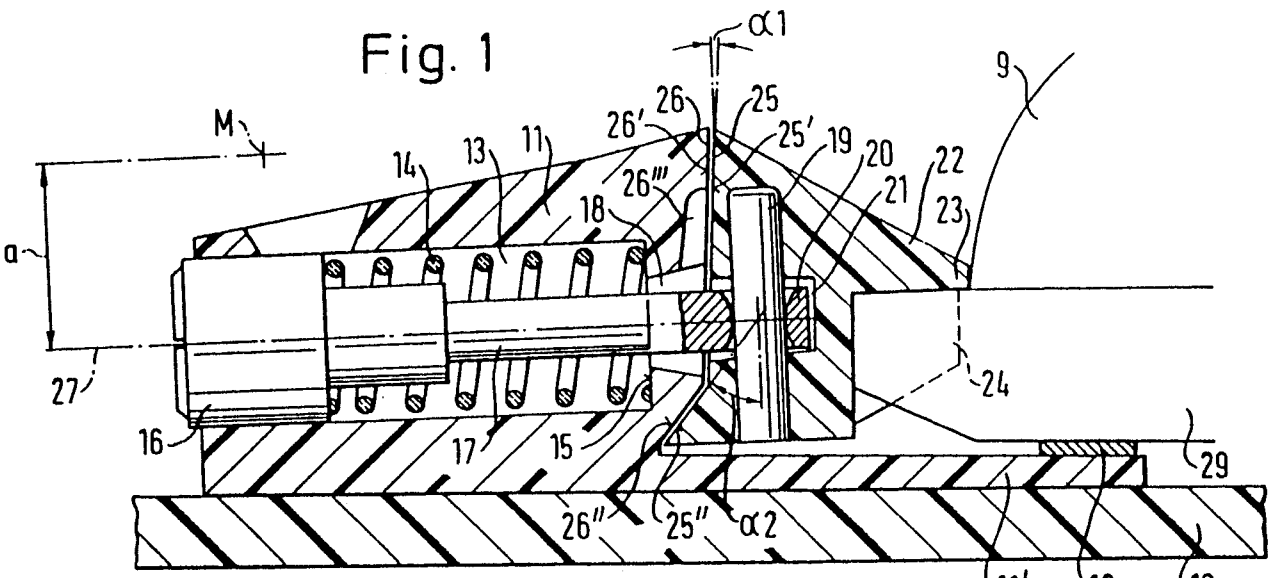
FIG. 1 is a partly sectioned schematic sideview of a first embodiment of a sideways releasable jaw.
Figure 2:
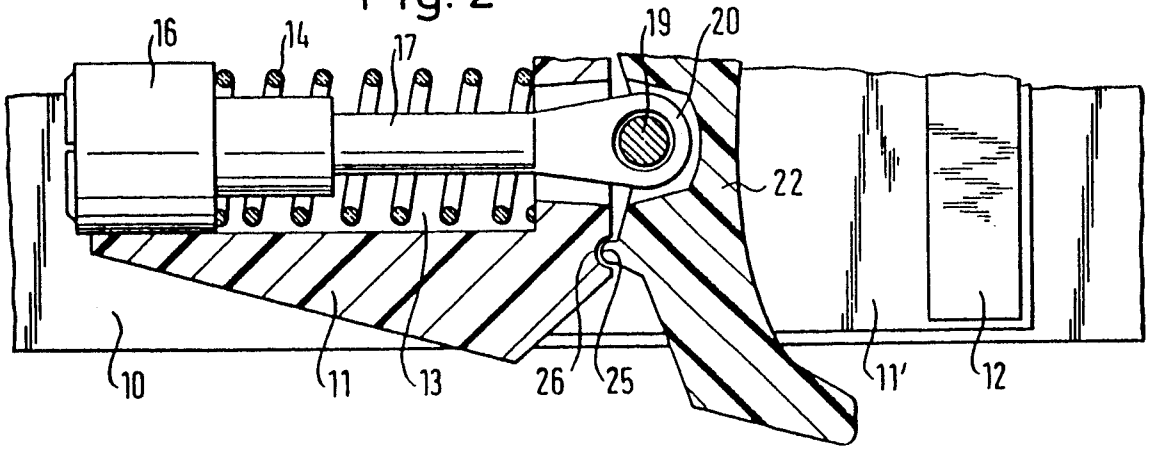
FIG. 2 is a partly sectioned schematic plane view of the subject of FIG. 1.

In accordance with FIG. 1 the binding housing 11 of a front jaw is secured with non-illustrated means to a ski 10. A slide plate 12 is provided on a rear projection 11' of the binding housing 11 as seen in the running direction of the ski. The front region of the sole 29 of a ski boot 9 inserted into the jaw is supported from below by the slide plate 12.

In the front region of the binding housing 11 a release spring receiving chamber 13 is provided which extends obliquely to the longitudinal direction of the ski and in which a release spring 14 is arranged which is braced at its rear end against a ring wall 15 of the binding housing and at its front end against an axially adjustable abutment 16. A draw bar 17 is secured to the abutment 16 and has a securing eye 20 at its front end remote from the abutment 16 which passes through an opening 18 in the ring wall 15 of the binding housing 11.

A securing pin 19 extends through the securing eye 20 which is arranged in a recess 21 of a sole holder 22 and the securing pin 19 is inserted in two corresponding bores of the sole holder 22, so that the sole holder or clamp 22 is held by the release spring 14 via the abutment 16 and via the draw bar 17 in contact with and against the binding housing 11.

The sole clamp 22, which has a hold-down member 23 and two side limbs 24, of which only one is illustrated, is braced against the binding housing 11 by means of two sliding strips or noses 25 which are essentially upright in relation to the ski, with the sliding strips 25 engaging with corresponding sliding guides 26.

The sliding strips 25 or guides 26 are thereby arranged symmetrically to the longitudinal axis of the ski or symmetrically to the line of action 27 of the release spring 14, form tilting surfaces or counter tilting surfaces and determine the pivot axes about which the sole clamp 22 is pivoted when a ski boot 9 inserted into the toe unit exerts a force on one of the side limbs 24 of the sole clamp 22 which exceeds the release force.

The sliding strips 25 or guides 26 have a first upper straight section 25' or 26' and a second lower straight section 25', 26'. The first straight sections 25'', 26'' subtend a first angle $\alpha 1$, to the perpendicular to the line of action 27 of the release spring which is smaller than an angle $\alpha 2$ which the second straight sections of 25'' and 26'' subtend to the perpendicular to the line of action 27 of the release spring. Free cut-outs 26''' can thereby be provided in the sections 26'of the sliding guides 26.

As a result of the sliding strips 25 or guides 26 which are inclined relative to the perpendicular to the line of action of the release spring 14 the release spring 14 exerts a downwardly directed force on the sole clamp 22 so that the hold-down member 23 is pressed with an inserted ski boot 9 from above against the sole 29 of the ski boot so that the latter is clamped between the sliding plate 12 and the hold-down member 23.

As a result of the sections 25', 26' and 25'', 26'' respectively which are differentially inclined relative to the perpendicular to the line of action 27 of the release spring 14 and which form two differentially directed tilting axes depending on which region of these sections the sole clamp 22 is preferably braced against the binding housing, an instantaneous turning pole M is formed which has a spacing "a" from the line of action 27 of the release spring 14. In this way a turning moment arises which urges the sole clamp 22 downwardly.

So long as no ski boot is inserted into the corresponding ski binding the sole holder 22 is pressed by the release spring 14 downwardly against a lower abutment which can for example be formed by the upper side of the rear projection 11' of the binding housing 11. In this arrangement the sole holder 22 is supported essentially along the upper straight sections 25', 26' of the sliding strips 25 or guides 26 on the binding housing 11.

For the insertion of the ski boot 9 the front portion of the sole 29 of the ski boot is inserted into the gap between the hold-down member 23 and the sliding plate 12, whereupon the sole 29 of the ski boot is then pivoted about the slide plate 12 into the position parallel to the ski. In so doing the upper side of the front end of the sole of the ski boot 9 comes into engagement with the hold-down member 23 and thrusts the latter and thus the sole clamp 22 upwardly along the sliding surfaces 26 against the torque exerted by the release spring on the sole clamp 22 until the ski boot 9 is completely inserted into the binding.

If now during skiing an upwardly directed force is exerted on the hold-down member 23 from the front end of the sole 29 of the ski boot then the sole clamp 22 is moved upwardly against the downwardly directed force brought about by the release spring 14, and against the torque about the instantaneous turning pole M. As soon as the upwardly directed force falls away again the hold-down member 23 presses the sole of the ski boot against the sliding plate 12 again.

In this arrangement it is particularly advantageous that the lower sections 25", 26" of the sliding strips 25 or guides 26 are inclined by a larger angle $\alpha 2$ relative to the perpendicular to the line of action 27 of the release spring 14. In this manner the danger of the sole clamp 22 being caught up in an upper position as a consequence of increased friction between the sliding strips 25 and the guides 26 is avoided, because the frictional effect is substantially reduced by the larger inclination of the lower sections 25", 26".

In order to prevent an undesired large deflection of the sole clamp 22 upwardly an upper abutment, which is not shown, can be provided for the sole clamp 22. It can if necessary also serve as a tilting edge for a toe unit which is also releasably upwardly.

In order to increase the life of the sideways releasable jaw of the invention and to simultaneously suitably influence the friction between the sliding strips 25 and the guides 26 the sliding strips 25 and/or the sliding guides 26 can be formed of metal.

Figure 3:
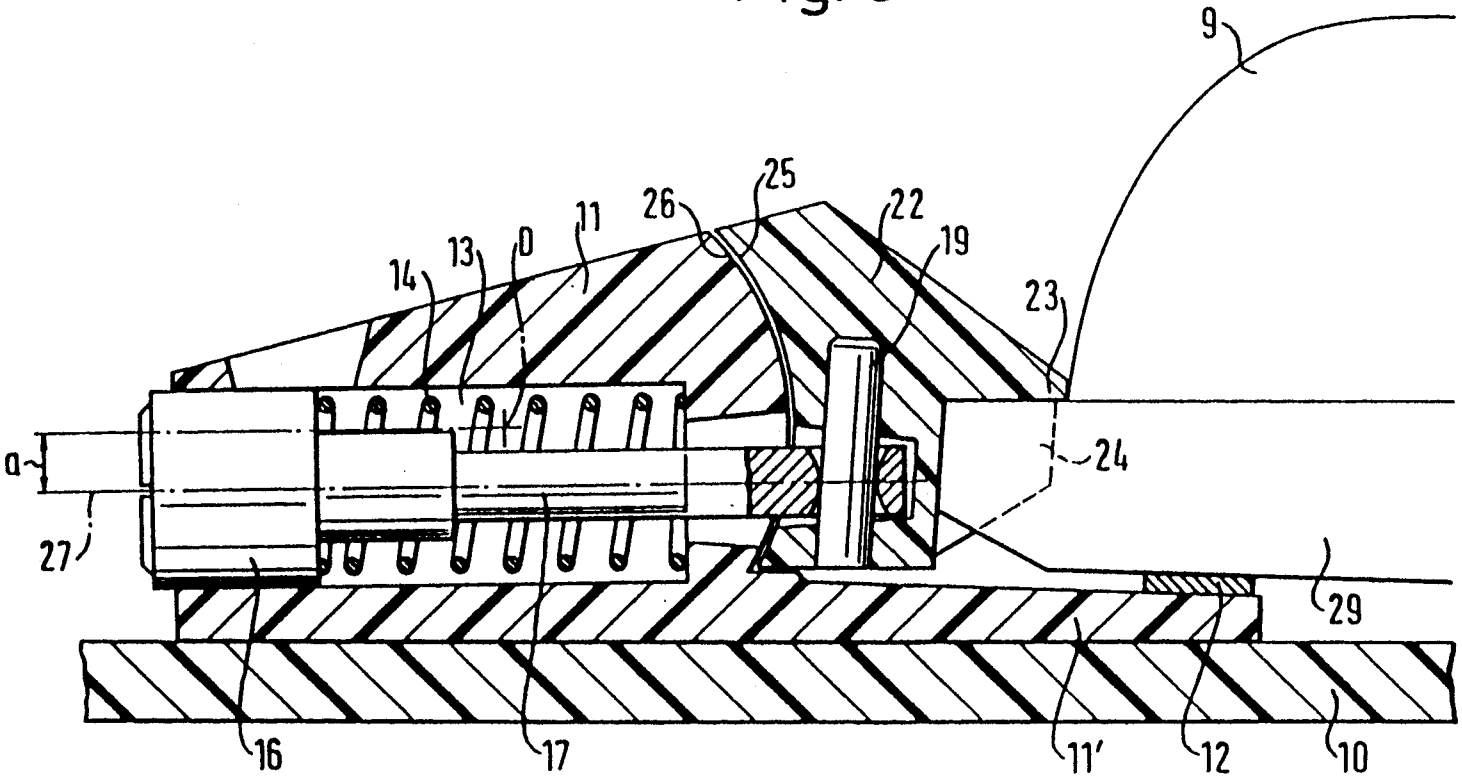
FIG. 3 is a partly sectioned sideview of a further embodiment of a sideways releasable jaw.

In the embodiment of FIG. 3 the sliding guides 26 are formed of circular arch-like shape, with the center of curvature D being arranged at a distance "a" from the line of action 27 of the release spring 14. The sliding strips 25 arranged on the sole clamp 22 have a concave circular arch-shape corresponding to the sliding guides 26.

Through the displacement of the center of curvature D of the circular arch-like sliding guides 26 or sliding strips 25 by the distance "a" relative to the line of action 27 of the release spring 14 a lever arm is formed so that the release spring force generates a torque about the point D which acts on the sole clamp 22 so that the sole clamp 22 moves in the direction towards the ski 10.

As a result of this torque the sole hold-down member 23 provided on the sole holder 22 can exert a holding force, when the ski boot is inserted, from above onto the sole of the ski boot and thus hold an inserted ski boot without play in the vertical direction in the binding.

With the sideways releasable jaw of FIG. 3 the sliding strips 26 and the sliding guides 26 again form the tilting surface or tilting counter-surface about which the sole clamp 22 pivots against the release spring force during sideways release.

Figure 4:
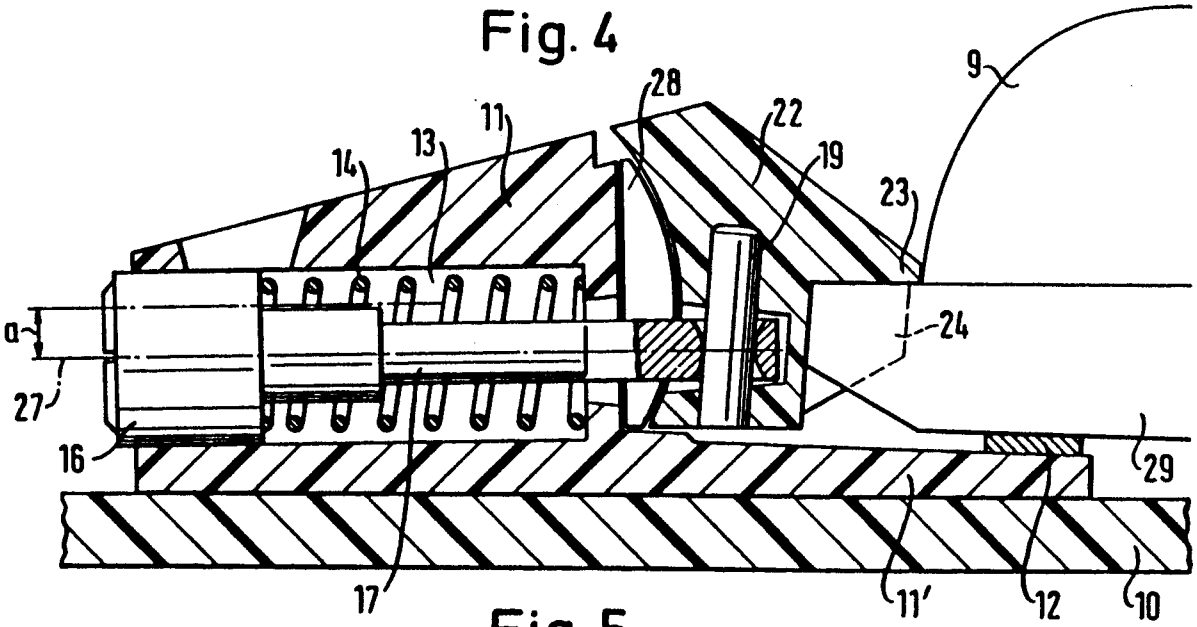
FIG. 4 is a partly sectioned schematic sideview of a modification of the jaw of FIG. 2.
Figure 5:
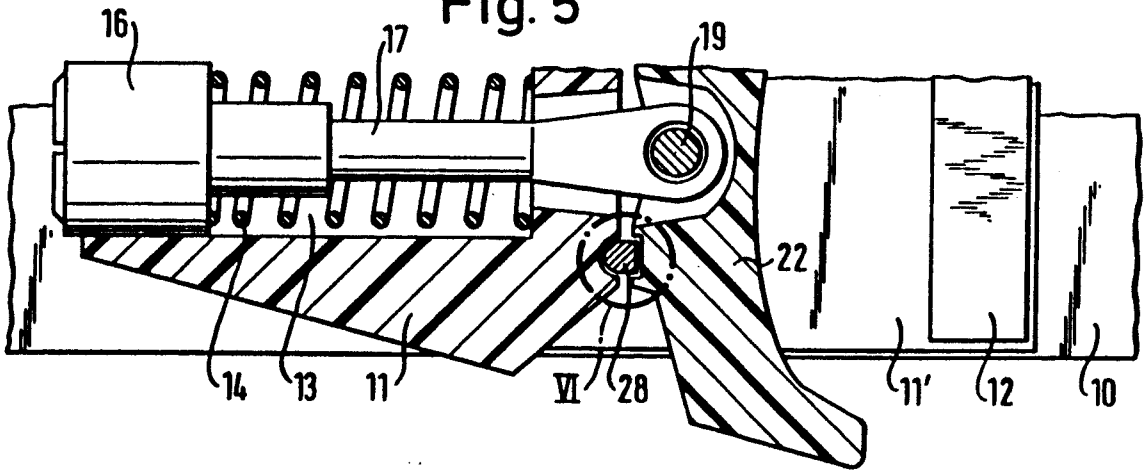
FIG. 5 is a partly sectioned schematic plane view of the subject of FIG. 4.
Figure 6:
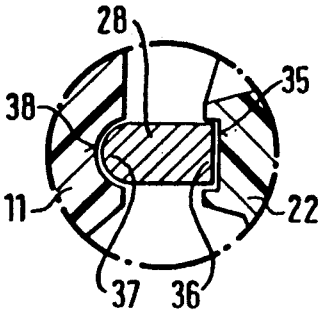
FIG. 6 is an enlarged sideview in accordance with the circle VI in FIG. 5.

In accordance with FIG. 4 to 6 the sliding guides of circular arch-like shape are again provided on the side of the releasable jaw and are formed by a sliding guide groove 35 and a sliding strip 36. The sliding strip 36 is provided on an intermediate piece 28 which is inserted between the sole clamp 22 and the binding housing 11. At its front edge, as seen in the direction of running of the ski, the intermediate piece 28 has a tilting strip or nose 37 which is preferably arranged in a corresponding groove 38 which forms a tilting surface on the sole clamp 11, whereas the counter-tilting surface is provided on the tilting strip 37 of the intermediate piece 28.

As can be seen particularly clearly in FIG. 4 the tilting axis defined by the tilting strip 37 and the groove 38 is arranged perpendicular to the line of action 27 of the release spring 14, so that the sole clamp 22 is pivoted during sideways release about a defined perpendicular tilting axis.

The separate arrangement of the tilting strip 37 and of the sliding strip 36 by means of an intermediate piece 28 makes it possible to freely select the radius of curvature of the circular arch-like sliding guides and also the distance "a" of the central curvature from the line of action 27 of the release spring 14 without the release behavior of the sole clamp being impaired.

What is claimed is:

1. A sideways releasable ski binding for holding a front end of a ski boot (9) on a ski, the boot having a sole with an upper side, the binding comprising a binding house (11), a release spring arranged in the housing which extends substantially in a longitudinal direction of the ski along a line of action and which is supported at one end of the binding housing (11) and with another end exerts a release force having a substantial component in the longitudinal direction of the ski in a direction away from the ski boot, a sole clamp (22) for engaging the ski boot front end, the side limbs (24) being mounted to pivot sideways about at least one essentially upright tilt axis and release the ski boot (9) when the boot exerts a predetermine sideways force, the sole clamp (22) being vertically displaceably arranged on the binding housing (11) along at least one essentially upright sliding guide (25, 26, 35, 36) which is inclined relative to the lien of action (27) of the release spring force to cause the generation of a downwardly directed force component urging the hold-down member (23) against the upper side of the sole, the sliding guide (25, 26) including at least an upper section and a lower section (25', 26', 25", 26") which are so differentially inclined relative to the lien of action (27) of the release spring force that an instantaneous turning center (M) is formed which is arranged at a distance (a) above the line of action (27) of the release spring force, the upper section of the sliding strip (25) having a lesser inclination relative to the line of action (27) of the release spring than the lower section.

2. A ski binding in accordance with claim 1, wherein the sliding guide comprises a sliding strip (25, 26) and a corresponding sliding guide surface (26, 35), at least a portion of the sliding strip (25, 36) being made of a material having an elevated resistance to wear.

3. A ski binding in accordance with claim 2, wherein the entire sliding strip (25, 36) is made of wear resistant material.

4. A ski binding in accordance with claim 1, including two sliding guides arranged symmetrically to a central longitudinal plane of the ski perpendicular to the surface of the ski and which each have a sliding strip (25, 36) and an associated sliding guide surface (26, 35).

5. A ski binding in accordance with claim 4, including means defining tilting axes for lateral outward pivoting of the sole clamp (22) and arranged proximate to the sliding strips (25).

* * * * *